US005865255A

United States Patent [19]

Hammett et al.

[11] Patent Number: 5,865,255

[45] Date of Patent: Feb. 2, 1999

[54] FULL BORE NIPPLE AND ASSOCIATED LOCK MANDREL THEREFOR

[75] Inventors: Robert C. Hammett, Garland; David L. Reesing, Irving; Gordon K. Scott, Dallas, all of Tex.

[73] Assignee: Halliburton Energy Services, Inc., Dallas, Tex.

[21] Appl. No.: 798,973

[22] Filed: Feb. 11, 1997

[51] Int. Cl.[6] ..... E21B 23/60

[52] U.S. Cl. ..... 166/382; 166/115; 166/217

[58] Field of Search ..... 166/382, 115, 166/214, 217, 237, 242.1

[56] References Cited

U.S. PATENT DOCUMENTS

| | | | |
|---|---|---|---|
| 4,418,750 | 12/1983 | Paschal, Jr. | 166/214 |
| 4,997,038 | 3/1991 | Welch | 166/214 |
| 5,348,087 | 9/1994 | Williamson, Jr. | 166/115 |
| 5,390,735 | 2/1995 | Williamson, Jr. | 166/115 |
| 5,617,918 | 4/1997 | Cooksey et al. | 166/115 |

*Primary Examiner*—William Neuder

*Attorney, Agent, or Firm*—Paul I. Herman; Marlin R. Smith

[57] ABSTRACT

An improved full bore nipple and associated lock mandrel provides enhanced sealing capability in tubing strings positioned in subterranean wells. In a described embodiment of the full bore nipple, a nipple body has a recessed seal surface and a latch profile formed on an internal bore of the body. In a described embodiment of the lock mandrel, an expander sleeve radially outwardly expands a circumferential seal to sealingly engage the recessed seal surface, locks a series of keys into the latch profile, and displaces another seal to sealingly engage an outer housing, when the expander sleeve is displaced axially downward relative to an inner mandrel of the lock mandrel.

40 Claims, 11 Drawing Sheets

FULL BORE NIPPLE AND ASSOCIATED LOCK MANDREL THEREFOR

BACKGROUND OF THE INVENTION

The present invention relates generally to nipples utilized in subterranean wells and, in a preferred embodiment thereof, more particularly provides an improved full bore nipple and a lock mandrel for use therewith.

In a subterranean well, one or more nipples are typically installed as part of a tubing string positioned within the well. Such nipples may serve many purposes. For example, a nipple may serve as a positive positioning device, by providing an internal shoulder or other profile for landing equipment within the tubing string. As another example, a nipple may serve as a sealing device, by providing an internal seal surface which may be sealingly engaged by equipment disposed therein.

Where circumferential seals, such as packing or orings, are carried externally on equipment disposed within the nipple, it is common practice for such seals to have a smaller diameter than the tubing's internal drift diameter. In this way, the seals may easily pass axially through the tubing string to the nipple. Accordingly, internal seal surfaces of nipples typically have a smaller diameter than the tubing's drift diameter, so that the seal surfaces may sealingly engage the seals.

Unfortunately, a nipple seal surface which is smaller than the tubing drift diameter presents a restriction in the tubing string. Such restriction inhibits fluid flow through the tubing string, is quickly eroded by such fluid flow, restricts the diameter of equipment which may be passed axially therethrough, and otherwise inhibits operations in the well. For these reasons, it is generally desirable for all portions of the tubing string to have a minimum internal diameter which is at least as large as the tubing drift diameter. Those portions of a tubing string meeting this requirement are said to be "full bore".

Recently, full bore nipples have become available and are well known to those skilled in the art. For example, U.S. Pat. Nos. 5,348,087 and 5,390,735, each of which is assigned to the assignee of the present invention, disclose full bore nipples and lock mandrels therefor. The disclosures of these patents are hereby incorporated herein by this reference. In basic terms, such full bore nipples have a seal diameter at least as large as the tubing drift diameter, and the lock mandrels therefor have a seal which is radially outwardly extendable, so that the seal may pass through the tubing string when the seal is inwardly retracted, and the seal may sealingly engage the seal surface of the nipple when the seal is outwardly extended.

However, with the seal surface of a full bore nipple being generally aligned with the tubing drift diameter, several problems remain associated therewith. For example, the seal surface is still directly exposed to fluid flow through the tubing string. Where the fluid is abrasive, or carries abrasive particles therewith, the seal surface may become eroded, and weight loss corrosion may also result from the fluid flow. As another example, the seal surface may be damaged by equipment passing axially therethrough. As yet another example, the seal surface may be damaged by slickline, wireline, coiled tubing, etc., cutting into the seal surface as the slickline, etc., is axially reciprocated within the tubing string.

From the foregoing, it can be seen that it would be quite desirable to provide a full bore nipple which includes a recessed seal surface that is protected from fluid flow and equipment, slicklines, etc., passing through the nipple. Additionally, it would be desirable to provide a lock mandrel for such a full bore nipple, which is capable of locking to the nipple and sealingly engaging therewith. It is accordingly an object of the present invention to provide such a full bore nipple, lock mandrel therefor, and associated methods of configuring a tubing string within a subterranean well. Other objects, features, and benefits of the present invention will become apparent upon consideration of the detailed description hereinbelow.

SUMMARY OF THE INVENTION

In carrying out the principles of the present invention, in accordance with an embodiment thereof, an improved full bore nipple is provided which has a recessed seal bore formed therein, utilization of which does not subject the seal bore directly to fluid flow and equipment passing through the nipple. A lock mandrel is also provided for the nipple, the lock mandrel being capable of expanding a seal outward to sealingly engage the recessed seal bore. For positioning the lock mandrel or other equipment within the nipple, a latching profile is formed internally on the nipple.

In broad terms, a nipple is provided for use in a subterranean well in conjunction with a well tool having a radially outwardly extendable seal carried thereon. The nipple includes a generally tubular housing. A generally cylindrical internal bore extends axially through the housing, the internal bore having a first diameter.

A shoulder is formed internally on the housing. The shoulder is capable of axially engaging the well tool when the well tool is inserted axially into the internal bore. A seal surface is formed internally on the housing, the seal surface being axially spaced apart from the shoulder. The seal surface has a second diameter greater than the first diameter of the internal bore, and is capable of sealing engagement with the seal when the seal is radially outwardly extended from the well tool.

In another aspect of the present invention, a full bore nipple is provided for use with a well tool having a generally tubular outer housing and a circumferential seal, the seal being radially outwardly extendable relative to the outer housing. The nipple includes a generally tubular body with first and second internal diameters. The body is configured for axial insertion of the well tool thereinto, and the first internal diameter is capable of receiving the outer housing axially therein.

The second internal diameter extends axially within the body. It is radially outwardly disposed relative to the first internal diameter, and is capable of engagement with the seal when the outer housing is received axially within the first internal diameter and the seal is radially outwardly extended relative to the outer housing.

Also provided is an apparatus for use in a subterranean well. The apparatus includes a generally tubular mandrel, a generally tubular expander sleeve, a circumferential seal, and a generally tubular outer sleeve. The expander sleeve is axially slidingly disposed externally on the mandrel and has first and second external diameters formed thereon. The second external diameter is larger than the first external diameter. The expander sleeve is selectively positionable in first and second axial positions relative to the mandrel, and the expander sleeve has an opening formed through a sidewall portion thereof.

The seal is disposed externally relative to the expander sleeve. It is disposed radially outward of the first external diameter when the expander sleeve is in the first position, and is disposed radially outward of the second external diameter when the expander sleeve is in the second position. The outer sleeve is axially slidingly disposed externally about the expander sleeve, and is releasably attached to the mandrel radially, through the expander sleeve opening.

In yet another aspect of the present invention, an apparatus for use in a subterranean well is provided. The apparatus includes generally tubular mandrel, housing, and expander sleeve, and a seal. The housing is radially outwardly disposed relative to the mandrel and at least partially radially spaced apart therefrom. One of the housing opposite ends is attached to one of the mandrel opposite ends.

The expander sleeve has an outer side surface, and is axially reciprocably disposed radially between the mandrel and the housing. The expander sleeve is positionable relative to the housing in a selected one of first and second axial positions, the first circumferential seal sealingly engaging the expander sleeve outer side surface and the housing when the expander sleeve is in the second axial position.

Additionally, apparatus for connection to a tubing string having an inner side surface and positionable within a subterranean well is also provided. The apparatus includes a generally tubular housing and expander sleeve, and first and second circumferential seals.

The housing has inner and outer side surfaces, and is axially displaceable through the tubing string. The expander sleeve has inner and outer side surfaces, and is axially positionable relative to the housing in a selected one of first and second positions. The expander sleeve outer side surface and the housing inner side surface are sealingly engaged by the first circumferential seal, and the second circumferential seal sealingly engages the expander sleeve outer side surface, when the expander sleeve is in the second position. The second circumferential seal is capable of sealingly engaging the tubing string inner side surface when the expander sleeve is in the second position.

A method of configuring a tubing string within a subterranean well is also provided, which method includes the steps of providing the tubing string having an internal drift diameter; providing a nipple, the nipple including a generally tubular housing having opposite ends, the opposite ends being configured for interconnection of the housing within the tubing string, an axially extending internal bore formed in the housing, the internal bore having a diameter at least as large as the tubing string drift diameter, and a seal surface formed in the housing axially between the internal bore and one of the opposite ends, the seal surface being radially outwardly disposed relative to the internal bore; interconnecting the nipple to the tubing string; and positioning the tubing string within the well.

The use of the present invention increases the economics, convenience, and efficiency of operations in subterranean wells involving nipples installed in tubing strings. The disclosed full bore nipple, and associated lock mandrel and methods, prevent damage to a seal bore within the nipple, thereby enabling prolonged use of the nipple without repair or replacement.

DETAILED DESCRIPTION

Figure 1A:
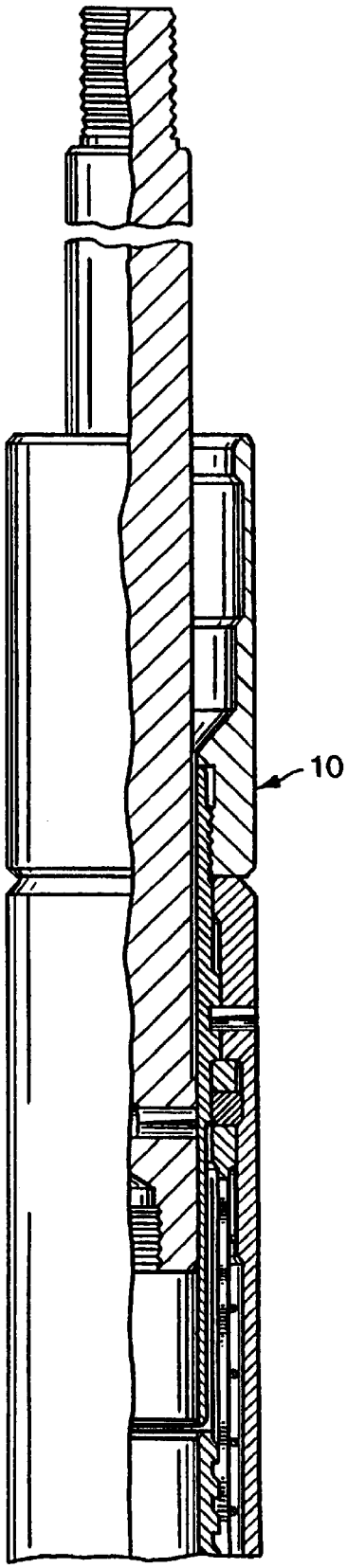
FIGS. 1A–1C are partially elevational and partially cross-sectional views of a full bore nipple and lock mandrel therefor.
Figure 1B:
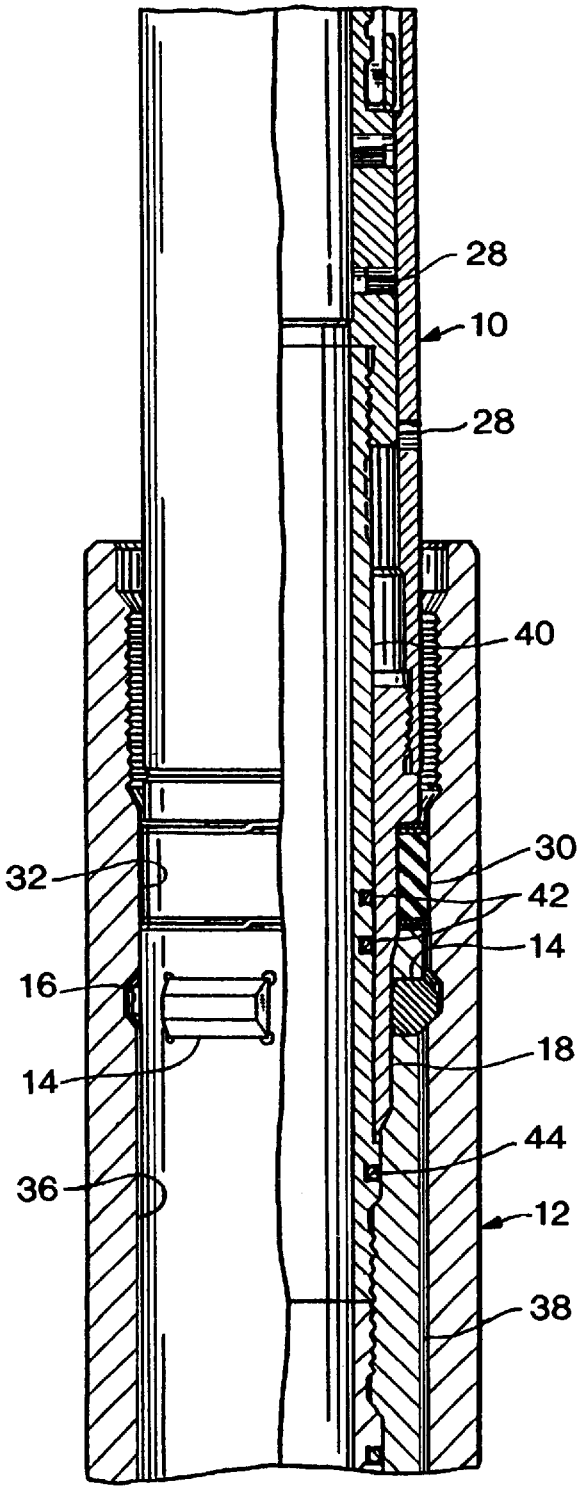
Figure 1C:
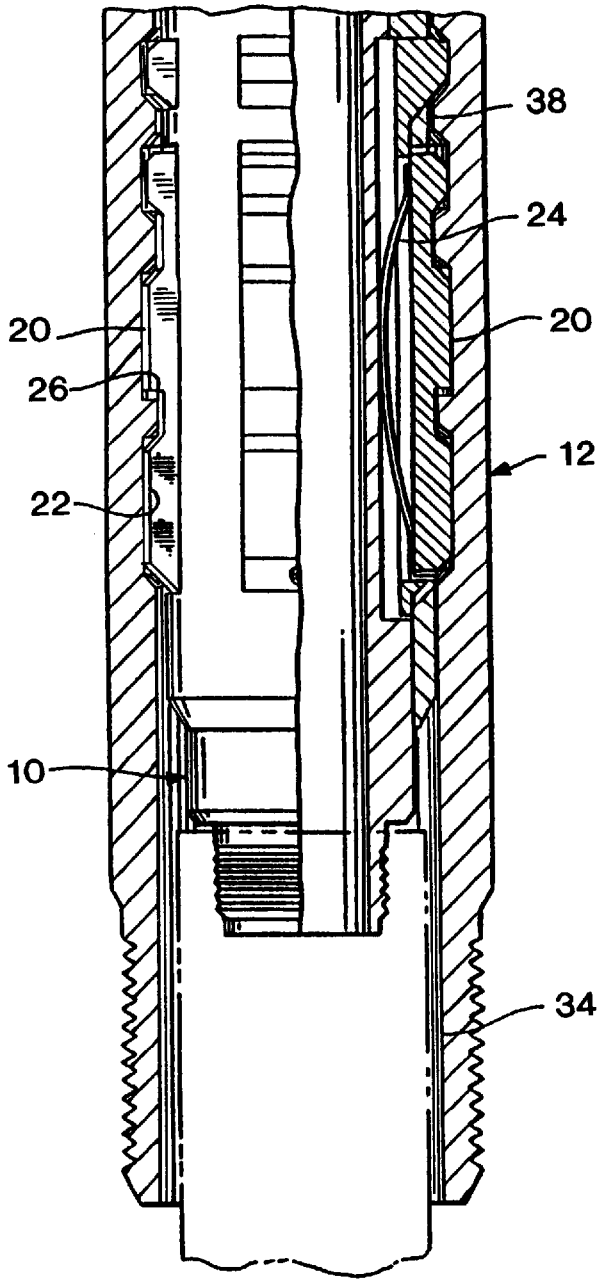

Illustrated in FIGS. 1A–1C is a lock mandrel 10 and a full bore nipple 12. The lock mandrel 10 and nipple 12 are similar to those described in U.S. Pat. No. 5,390,735. As shown in FIGS. 1A–1C, the lock mandrel 10 has been inserted axially into the nipple 12, and has been set therein, that is, the lock mandrel is anchored to, and sealingly engages, the nipple.

Anchoring of the lock mandrel 10 to the nipple 12 is achieved by engagement of a series of circumferentially spaced apart keys 14 carried on the lock mandrel, with a circumferential groove 16 formed internally on the nipple. The keys 14 are displaced radially outward into engagement with the groove by an expander sleeve 18. The expander sleeve 18 is shown in FIG. 1B in a downwardly displaced configuration relative to the keys 14. When the expander sleeve 18 is in an upwardly displaced configuration relative to the keys 14, such as when the lock mandrel 10 is being transported downward through a tubing string (not shown) attached to the nipple 12, the keys are permitted to inwardly retract, since the expander sleeve does not radially inwardly contact the keys in that configuration.

The lock mandrel 10 is axially positioned for setting within the nipple 12 by engagement of a second set of keys 20 carried on the lock mandrel with a complementarily shaped latch profile 22 formed internally in the nipple. The keys 20 are resiliently biased radially outward by springs 24, so that, before the lock mandrel 10 is set in the nipple and as the lock mandrel is displaced downwardly through the tubing string, the keys are permitted to retract inwardly. However, when the keys engage the profile 22, an upwardly facing shoulder 26 of the profile prevents further downward displacement of the lock mandrel 10 relative to the nipple 12. A downwardly directed jarring force may then be applied to the lock mandrel 10 to shear shear pin 28 and thereby displace the expander sleeve 18 to its illustrated downwardly displaced configuration.

When displaced axially downward as shown in FIG. lB, the expander sleeve 18 forces a circumferential seal 30 radially outward to sealingly engage a seal bore 32 formed internally in the nipple 12. Such sealing engagement is typically required for proper operation of a safety valve or other equipment 34 suspended from the lock mandrel 10 below the seal 30. The seal bore 32 has a diameter which is approximately equal to the remainder of an internal bore 36 on which the groove 16 and profile 22 are formed.

Since the seal bore 32 and internal bore 36 have approximately equal diameters, the seal bore may be contacted by the lock mandrel 10, safety valve 34, or any other item of equipment which may pass axially through the nipple 12.

Such contact between the seal bore 32 and various equipment passing through the nipple 12 may easily damage the seal bore, preventing the seal 30 from achieving proper sealing engagement therewith. In particular, a slickline, wireline, coiled tubing, etc., may lay against a lower side of the seal bore 32 and wear away a portion of the seal bore, thereby preventing sealing engagement of the seal 30 with the seal bore. The applicants have observed significant abrasion of a seal bore due to prolonged traversal of a slickline through a nipple, and it is quite common for appreciable abrasion to occur where extensive slickline jarring is performed on a single job.

The seal bore 32 is also exposed directly to fluids flowing axially through the nipple 12. The fluids, and/or abrasive particles carried by the fluids, may easily erode the seal bore 32, so that the seal 30 is prevented from sealingly engaging the seal bore. Additionally, weight loss corrosion of the seal bore 32 is aided by the exposure of the seal bore to the fluid flow axially through the nipple 12. Thus, it may be readily appreciated that the seal bore 32 is substantially unprotected in the nipple 12, even though the nipple is of the full bore type.

Note that, due to the configuration of the expander sleeve 18 relative to an outer housing 38 and inner mandrel 40, between which the expander sleeve slidingly reciprocates between its upwardly and downwardly displaced configurations, the inner mandrel carries circumferential seals 42, 44 thereon for sealing engagement with the expander sleeve and outer housing, respectively. These seals 42, 44 effectively reduce the cross-sectional area of the inner mandrel 40 and, thus, weaken the inner mandrel. To compensate for this, the inner mandrel 40 must be made thicker, thereby reducing the available radial thickness of the expander sleeve 18. Such reduced radial thickness of the expander sleeve 18 limits the radial displacement (i.e., the "throw") available to radially outwardly extend the seal 30 into contact with the seal bore 32 and to radially outwardly extend the keys 14 into engagement with the groove 16. It will be readily apparent that an increased radial throw is desirable for increased radial expansion of the seal 30 and radial displacement of the keys 14.

Figure 2:
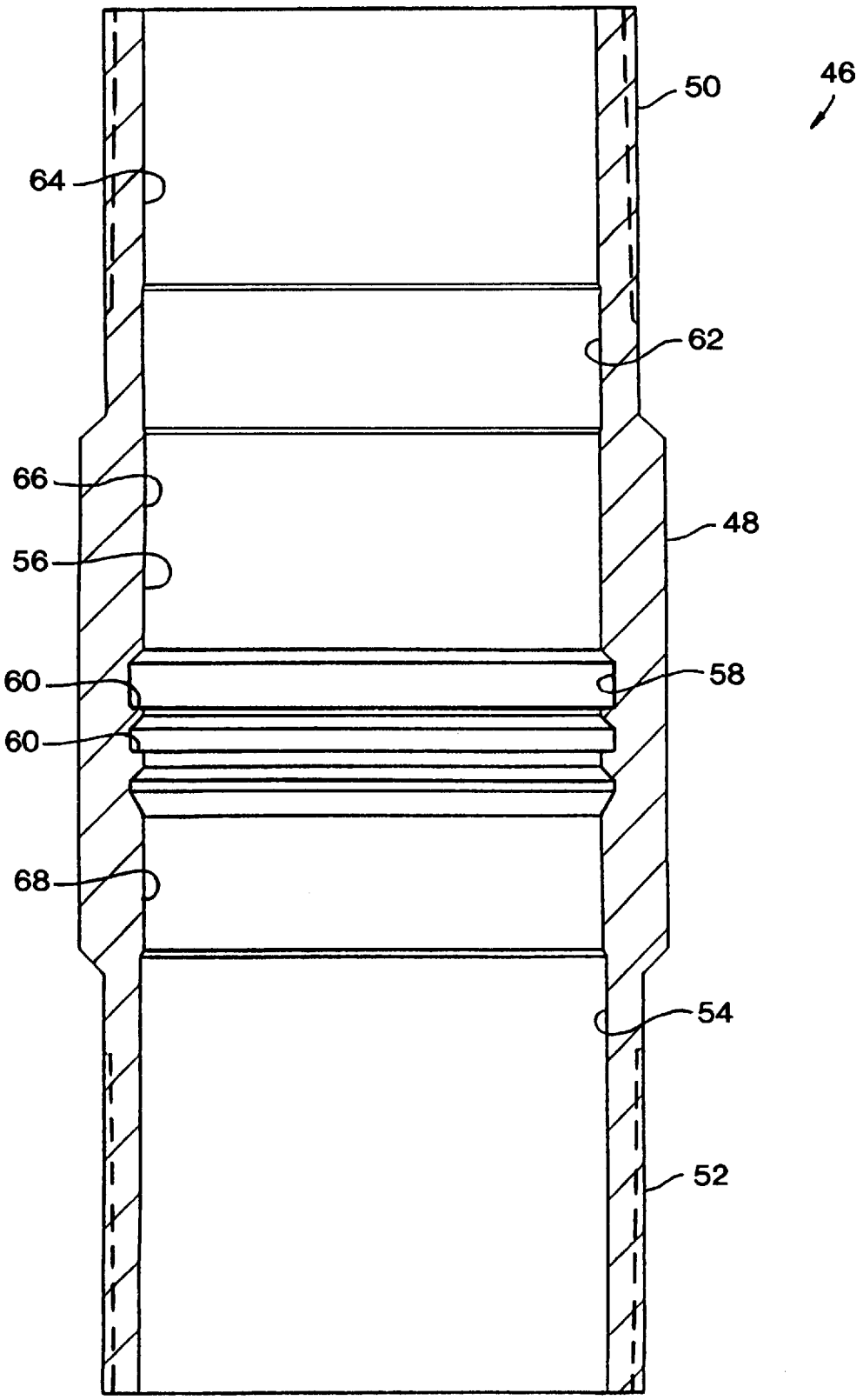
FIG. 2 is a cross-sectional view of an improved full bore nipple embodying principles of the present invention.

Turning now to FIG. 2, a full bore nipple 46 embodying principles of the present invention is representatively illustrated. In the following description of the nipple 46 and other embodiments of the present invention hereinbelow, directional terms, such as "above", "below", "upward", "downward", "upper", "lower", etc., are used for convenience to refer to the embodiments as they are illustrated in the accompanying drawings. Additionally, it is to be understood that the embodiments may be utilized in various orientations, such as, horizontal, vertical, inclined, inverted, etc., without departing from the principles of the present invention.

The nipple 46 has a generally tubular body or housing 48 with opposite ends 50, 52, each of which is externally threaded for attachment of the nipple within a tubing string for transport and positioning within a subterranean well. The body 48 has an interior side surface 54 defined in substantial part by an internal bore 56. The internal bore 56 has a diameter which is at least as great as the drift diameter of the tubing string to which it is attached, hence the nipple 46 is of the full bore type.

A latch profile 58 is formed on the interior side surface 54, extending generally radially outward from the internal bore 56. The profile 58 includes at least one upwardly facing shoulder 60. Above the profile 58, a seal bore 62 is formed on the interior side surface 54, extending radially outward from the internal bore 56. Note that, in the illustrated embodiment, the internal bore 56 has a first portion 64 above the seal bore 62, a second portion 66 axially between the seal bore 62 and the profile 58, and a third portion 68 below the profile 58. The seal bore 62 has a diameter which is greater than the diameter of either of the first and second portions 64, 66 of the internal bore 56.

It will be readily appreciated that, with the seal bore 62 axially straddled by the smaller diameter first and second portions 64, 66, the seal bore is substantially protected from contact with equipment, slicklines, etc., passing axially through the internal bore 56 of the nipple 46. It will also be readily appreciated that the seal bore 62 is protected from direct exposure to axial fluid flow through the internal bore 56, thereby preventing, or at least reducing, erosion and weight loss corrosion of the seal bore. The applicants prefer that the seal bore 62 diameter is approximately 0.05 inch greater than the diameter of either of the first and second portions 64, 66, but it is to be understood that other relative diameters may be utilized without departing from the principles of the present invention.

Figure 3:
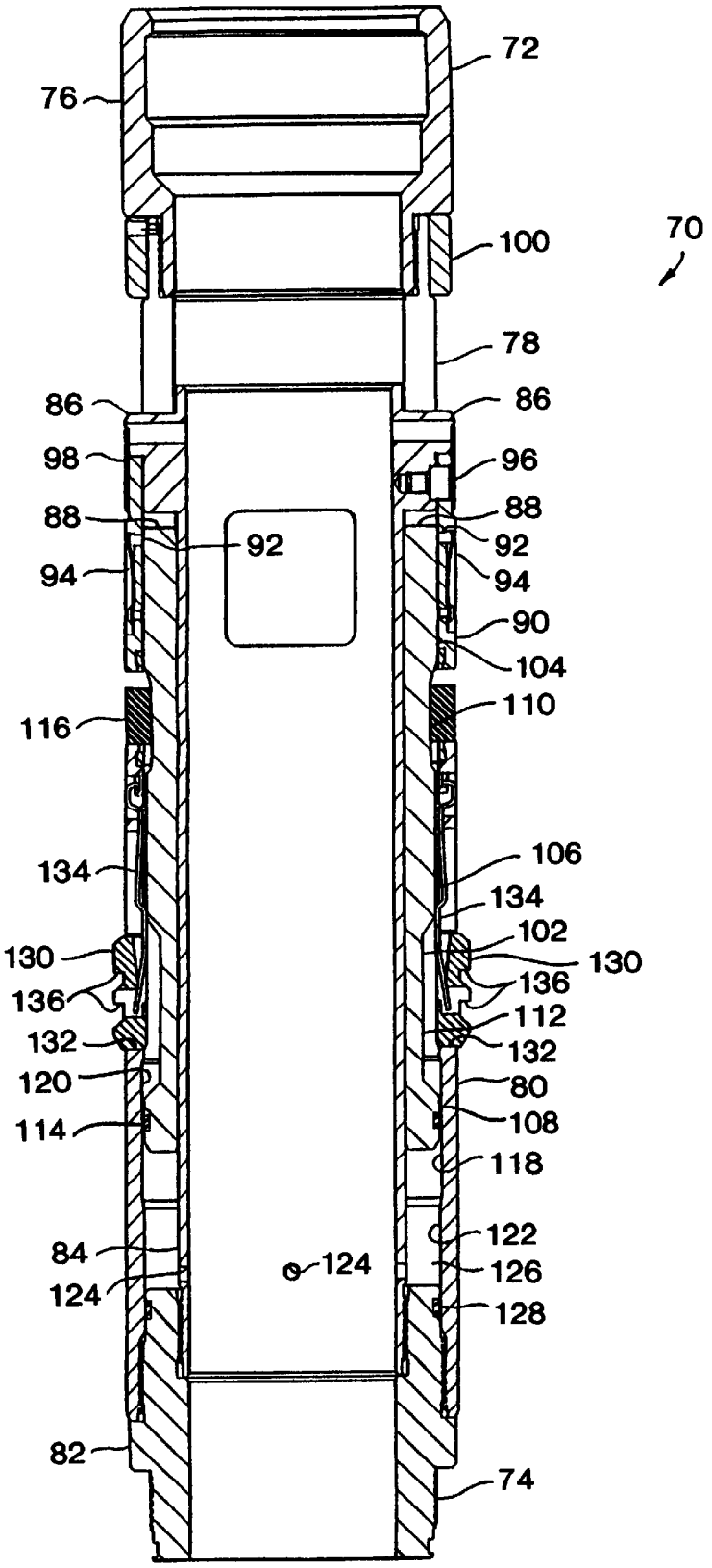
FIG. 3 is a cross-sectional view of a lock mandrel for use in association with the full bore nipple of FIG. 2, the lock mandrel embodying principles of the present invention.

Referring additionally now to FIG. 3, a lock mandrel 70 embodying principles of the present invention is representatively illustrated. The lock mandrel 70 is configured for use with the nipple 46, but it is to be understood that, with suitable modification if necessary, the lock mandrel may be utilized with other nipples without departing from the principles of the present invention.

As shown in FIG. 3, the lock mandrel 70 is prepared for transport through the tubing string to which the nipple 46 is attached. At its upper end 72, the lock mandrel 70 may be attached to a conventional running tool. At its lower end 74, a safety valve or other equipment (not shown) may be attached according to conventional practice.

A generally tubular fishing head 76 at the upper end 72 is threadedly attached to a generally tubular expander sleeve 78. The expander sleeve 78 extends axially downward from the fishing head 76 and into a generally tubular outer housing 80. The expander sleeve 78 is slidingly received in the outer housing 80 which is threadedly and sealingly attached at its lower end to a generally tubular bottom head 82. The bottom head 82 is threadedly attached to a generally tubular inner mandrel 84, which extends axially upward from the bottom head, so that the inner mandrel substantially radially inwardly overlies the expander sleeve 78.

At its upper end, the inner mandrel 84 has two radially outwardly extending portions 86. Each of the portions 86 is axially slidingly received in an axially extending slot 88 formed through the expander sleeve 78. Note that such engagement of the portions 86 with the slots 88 prevents circumferential displacement of the inner mandrel 84 relative to the expander sleeve 78, while permitting axial displacement of the expander sleeve relative to the inner mandrel.

Attached to the portions 86 is a generally tubular outer sleeve 90. The outer sleeve 90 extends downwardly from the portions 86 and externally overlies a portion of the expander sleeve 78. A pair of shear pins 92 extend radially through the outer sleeve 90 and are biased inwardly into contact with the expander sleeve 78 by a pair of springs 94. The shear pins 92 and springs 94 are shown in FIG. 3 rotated about the expander sleeve 78 ninety degrees for illustrative clarity. When the expander sleeve 78 is displaced downwardly relative to the inner mandrel 84 as described more fully hereinbelow, the shear pins are permitted to displace radially inwardly to engage a pair of recesses (not visible in FIG. 3, see FIG. 9) formed on the expander sleeve. Thus, when the expander sleeve 78 is downwardly displaced relative to the inner mandrel 84, such that the shear pins 92 are permitted to radially inwardly displace, the expander sleeve and inner mandrel are releasably axially engaged. Thereafter, the shear pins 92 must be sheared to permit relative axial displacement between the expander sleeve 78 and the inner mandrel 84.

A fastener 96 releasably secures the outer sleeve 90 to the inner mandrel 84. A relatively thin cross-sectioned tubular C-shaped cover 98 is installed over the fastener 96 and about the outer sleeve 90 and portions 86.

Above the portions 86, and adjacent the threaded attachment of the fishing head 76 to the expander sleeve 78, a retainer ring 100 is installed radially outwardly overlying the expander sleeve. The retainer ring 100 prevents radially outward expansion of the expander sleeve 78 relative to the fishing head 76, thereby preventing detachment of the expander sleeve from the fishing head at the threaded connection. Depending upon the cross-sectional thickness of the expander sleeve 78, the width of the slots 88, and other factors, the expander sleeve may deflect radially outward at the threaded connection when axial tension is applied to the lock mandrel 70, but it is to be understood that other embodiments may be readily configured (e.g., by increasing the cross-sectional thickness of the expander sleeve, reducing the width of the slots 88, etc.), so that it is not necessary to radially inwardly restrain the expander sleeve 78 at the threaded connection.

The expander sleeve 78 has an outer side surface 102 formed thereon. A series of three axially spaced apart portions 104, 106, and 108 of the outer side surface 102 have substantially the same diameter. Two radially reduced portions 110, 112 axially separate the portions 104, 106, and 108. A circumferential seal 114 is carried externally on the portion 108, and a radially outwardly extendable circumferential seal 116 is disposed externally about the portion 110. Note that, with the seal 116 disposed about the portion 110, the seal 116 has an outer diameter that is somewhat less than the outer diameter of the outer housing 80. In this manner, the seal 116 is protected from damage while the lock mandrel 70 is being transported through the tubing string.

With the expander sleeve 78 in its axially upwardly disposed configuration as representatively illustrated in FIG. 3, the seal 116 is radially inwardly retracted and the seal 114 is radially inwardly disposed relative to a radially enlarged portion 118 of an inner side surface 120 of the outer housing 80. The seal 114 does not sealingly engage the inner side surface 120 at this point. When the expander sleeve 78 is displaced to its downwardly disposed configuration, however, the portion 108 is received within a seal bore 122 formed on the inner side surface 120 and is sealingly engaged therewith, and the seal 116 is disposed about the portion 104, thereby radially outwardly extending the seal 116 so that its outer diameter is greater than the outer diameter of the outer housing 80. It will be readily appreciated that, for a given cross-sectional thickness of the lock mandrel 70, a thinner inner mandrel 84 allows a thicker expander sleeve 78, and, thus, permits a greater radial separation between the portions 104, 110, thereby increasing the available expansion or throw of the seal 116.

A series of circumferentially spaced apart ports 124 formed radially through the inner mandrel 84 provide fluid communication between the interior of the lock mandrel 70 and an annular space 126 axially between the expander sleeve 78 and the bottom head 82, and radially between the outer housing 80 and the inner mandrel. A circumferential seal 128 carried externally on the bottom head 82 sealingly engages the seal bore 122 adjacent the threaded connection between the bottom head and the outer housing 80.

A series of circumferentially spaced apart keys 130 are carried on the outer housing 80. Each of the keys 130 is radially slidingly received in an opening 132 formed through the outer housing 80. The keys 130 are resiliently biased radially outward by a series of springs 134 carried on the outer housing 80. Each of the keys 130 has at least one downwardly facing shoulder 136 formed externally thereon for axial engagement with the shoulder 60 of the nipple 46. In general, each of the keys 130 is complementarily shaped relative to the profile 58 formed on the interior side surface 54 of the nipple 46.

With the expander sleeve 78 in its upwardly disposed configuration as shown in FIG. 3, the keys 130 radially outwardly overly the portion 112 of the expander sleeve. In this configuration, the keys 130 are permitted to radially inwardly displace relative to the outer housing 80. In this manner, the keys 130 may inwardly retract while the lock mandrel 70 is transported through the tubing string. When, however, the expander sleeve 78 is positioned in its downwardly disposed configuration, the keys 130 will radially outwardly overly the portion 106, and the keys will be prevented from radially inwardly retracting due to radial contact between the keys and the portion 106.

Figure 4:
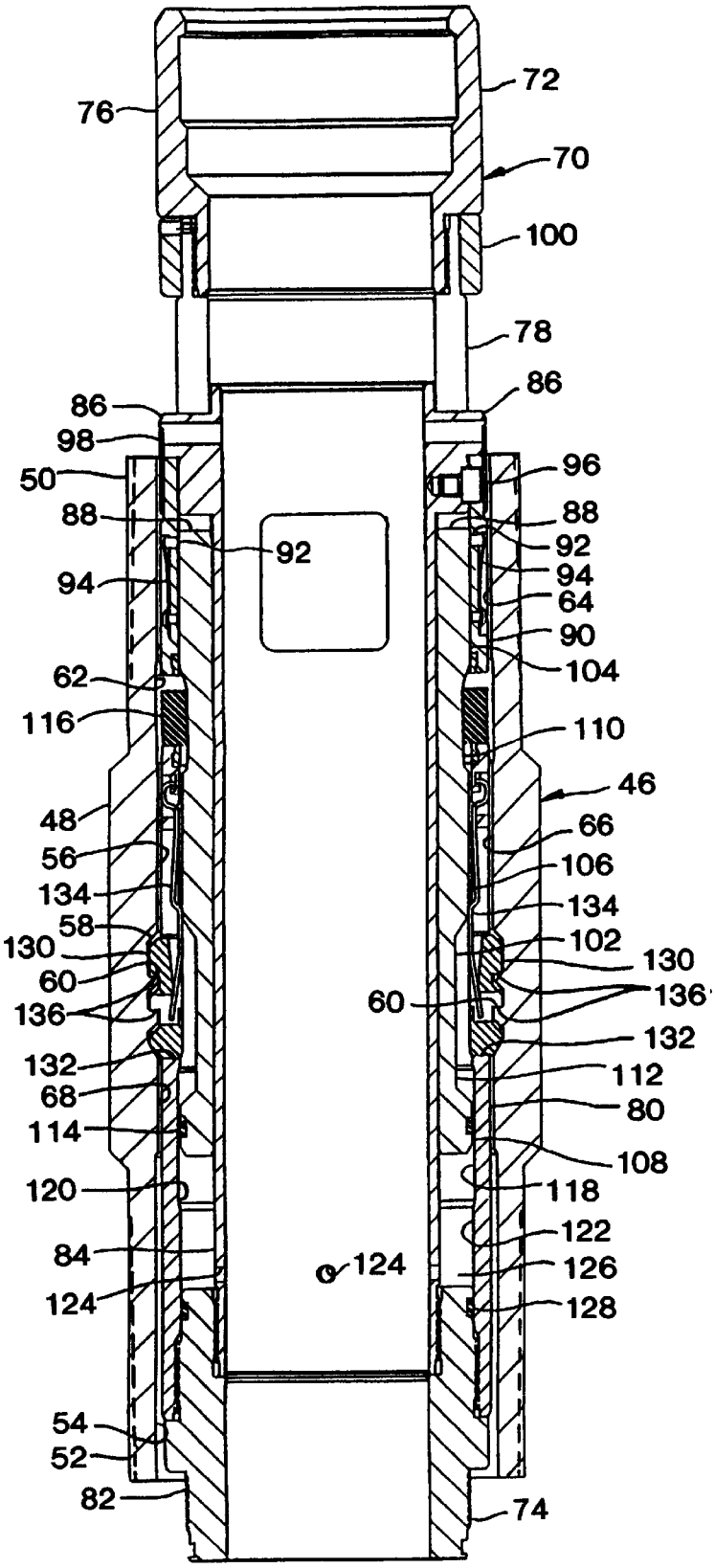
FIG. 4 is a cross-sectional view of the lock mandrel of FIG. 3 operatively landed in the full bore nipple of FIG. 2.

Referring additionally now to FIG. 4, the lock mandrel 70 is representatively illustrated inserted axially downwardly into the nipple 46. The keys 130 are radially outwardly received in the profile 58, such that the shoulders 60 of the profile axially engage the shoulders 136 of the keys. The lock mandrel 70 is, thus, positioned within the nipple 46 properly for being set therein. Note that the seal 116 is positioned radially inward from the recessed seal bore 62 of the nipple 46.

As shown in FIG. 4, the expander sleeve 78 remains in its axially upwardly disposed position relative to the inner mandrel 84 and outer housing 80. Therefore, the seal 116 is radially inwardly retracted and the seal 114 is axially spaced apart from the seal bore 122. When the expander sleeve 78 is displaced axially downward to its downwardly disposed position relative to the inner mandrel 84 and outer housing 80, the seal 116 will radially outwardly overly and sealingly engage the portion 104 of the expander sleeve and will be radially outwardly extended into sealing engagement with the seal bore 62, the seal 114 will sealingly- engage the seal bore 122, and the keys 130 will be prevented from disengaging from the profile 58 by radial contact with the portion 106.

Figure 5:
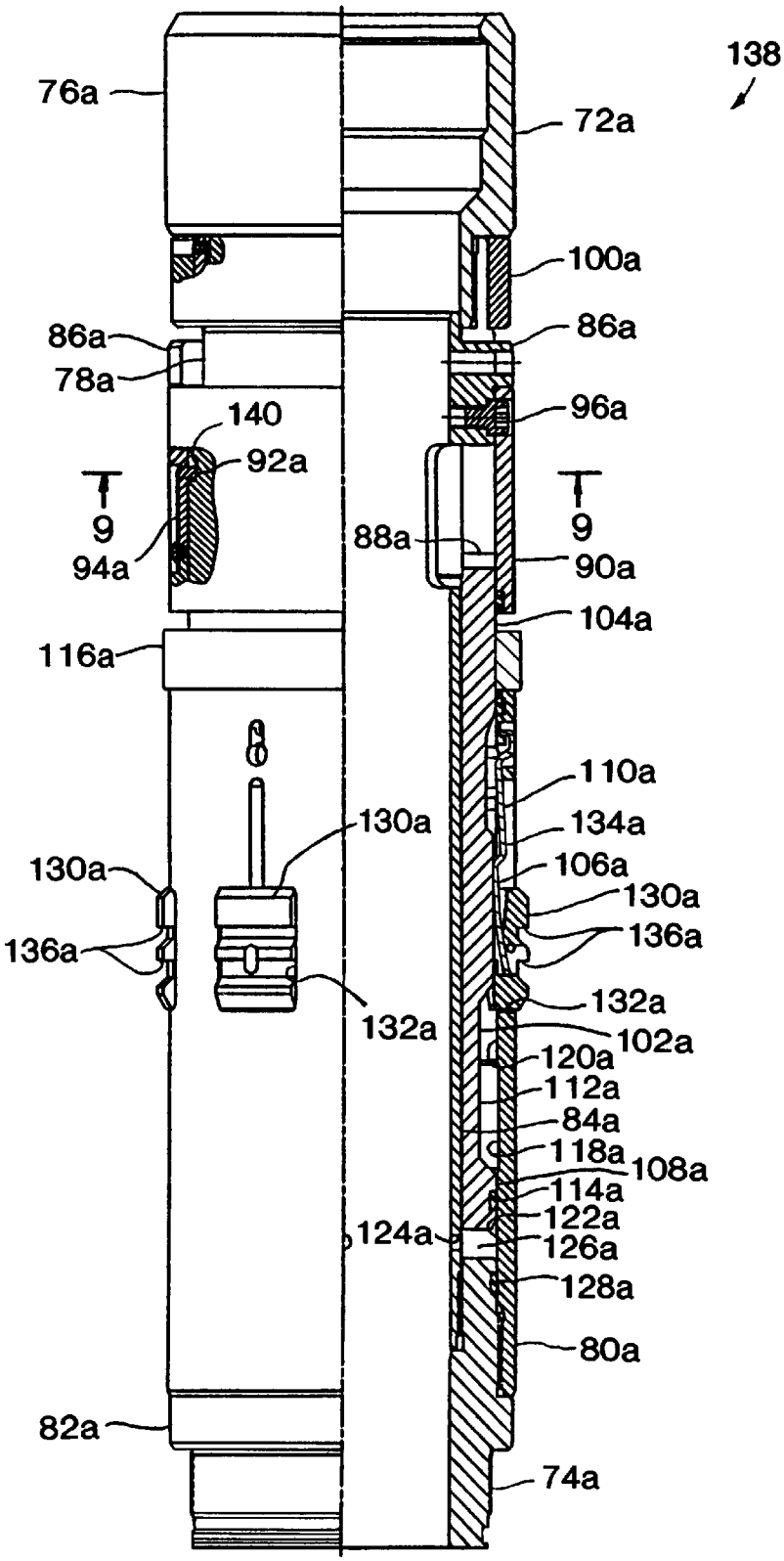
FIG. 5 is a partially elevational and partially cross-sectional view of another lock mandrel for use in association with the full bore nipple of FIG. 2, the lock mandrel embodying principles of the present invention.

Referring additionally now to FIG. 5, a lock mandrel 138 embodying principles of the present invention is representatively illustrated. The lock mandrel 138 is substantially similar to the previously described lock mandrel 70. Elements of the lock mandrel 138 which are similar to elements of the lock mandrel 70 described hereinabove are indicated using the same reference numerals, with an added suffix "a".

As shown in FIG. 5, the expander sleeve **78*a* is positioned in its downwardly disposed configuration. The expander sleeve 78*a* may be displaced from its upwardly disposed configuration to its downwardly disposed configuration by, for example, applying a downwardly directed force to the fishing head 76*a* while the keys 130*a* are engaged with the profile 58 of the nipple 46. For example, a conventional running tool may be utilized to exert a downwardly directed force to the fishing head 76*a***.

When positioned in its downwardly, disposed configuration, the expander sleeve 78*a* radially outwardly extends the seal 116*a*, radially outwardly retains the keys 130*a*, and positions the seal 114*a* so that it sealingly engages the seal bore 122*a*. Note that, at this point, the seal 116*a* has a greater outside diameter than does the outer housing 80*a*, so that the seal 116*a* may sealingly engage the seal bore 62 of the nipple 46. Note that each of the shear pins 92*a* is now received in a recess 140 formed externally on the expander sleeve 78*a*. When it is desired to remove the lock mandrel 138 from the nipple 46, an upwardly directed force may be applied to the fishing head 76*a* to thereby shear the shear pins 92*a* and axially upwardly displace the expander sleeve 78*a* from its downwardly, disposed configuration to its upwardly disposed configuration. The lock mandrel 138 may then be transported upwardly through the tubing string to the earth's surface.

One benefit of the unique design of the lock mandrel 138 is that the inner mandrel 84*a* is subjected to very limited forces during operation of the lock mandrel and may, therefore, be relatively thin in cross-section. With a relatively thin inner mandrel 84*a*, the expander sleeve 78*a* may be made relatively thick in cross-section, thus permitting a greater throw of the seal 116 radially outward. Preferably, the seal 116*a*, expander sleeve 78*a*, seal bore 62, etc., are designed so that the seal 116*a* is squeezed approximately 7% when the expander sleeve is in its downwardly disposed configuration and the seal 116*a* sealingly engages the seal bore 62.

A feature of the lock mandrel 138 which allows the inner mandrel 84*a* to have a relatively thin cross-section is the manner in which the seal 114*a* sealingly engages the seal bore 122*a* when the expander sleeve 78*a* is in its downwardly disposed configuration. Since the seal 114*a* seals at substantially the same diameter as the seal 116*a* sealingly engages the portion 104*a* of the expander sleeve 78*a*, the expander sleeve is axially, balanced with regard to fluid pressure applied radially inward of the portions 104*a*, 108*a*. The inner mandrel 84*a* is exposed on all of its external surfaces to the fluid pressure in the interior of the lock mandrel 138 and, therefore, is subjected to no significant forces due to fluid pressure applied thereto.

With the lock mandrel 138 set in the nipple 46, when fluid pressure above the seal 116*a* (e.g., in the interior of the tubing string above the nipple) is greater than fluid pressure below the seal 116*a* (e.g., in the interior of the tubing string below the nipple when the bottom head 82*a* is sealingly connected to a safety valve or other equipment, thereby isolating the interior of the lock mandrel 138 from the interior of the tubing string below the nipple), a downwardly directed axial force resulting from the fluid pressure differential applied to the cross-sectional area of the seal 116*a* is applied to the seal 116*a*, which abuts the outer housing 80*a*. The downwardly directed axial force is transferred to the keys 130*a* from the outer housing 80*a* (due to axial contact between the keys and the openings 132*a*), and the force is then transmitted to the nipple 46 via the axial contact between the shoulders 136*a*, 60.

Figure 6:
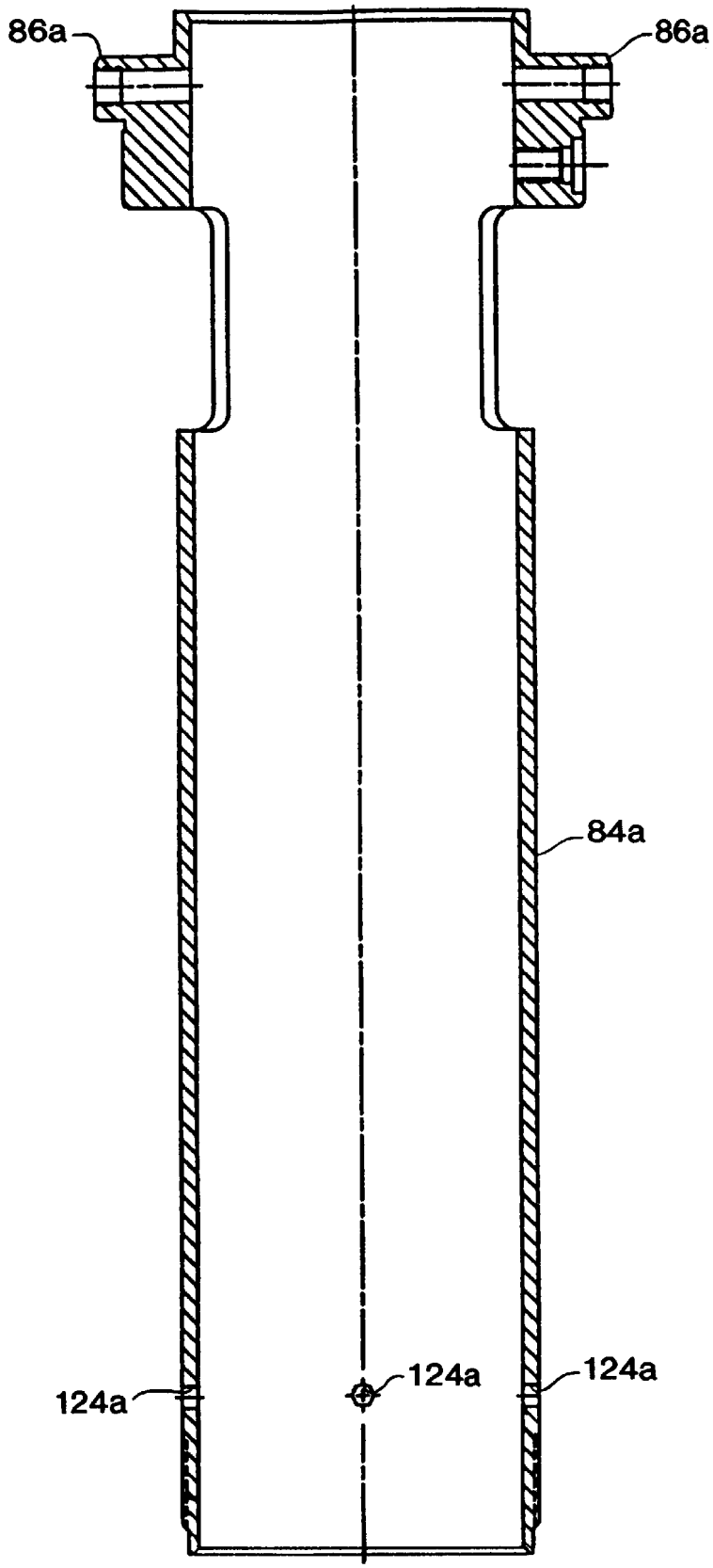
FIG. 6 is a cross-sectional view of an inner mandrel portion of the lock mandrel of FIG. 5.
Figure 7:
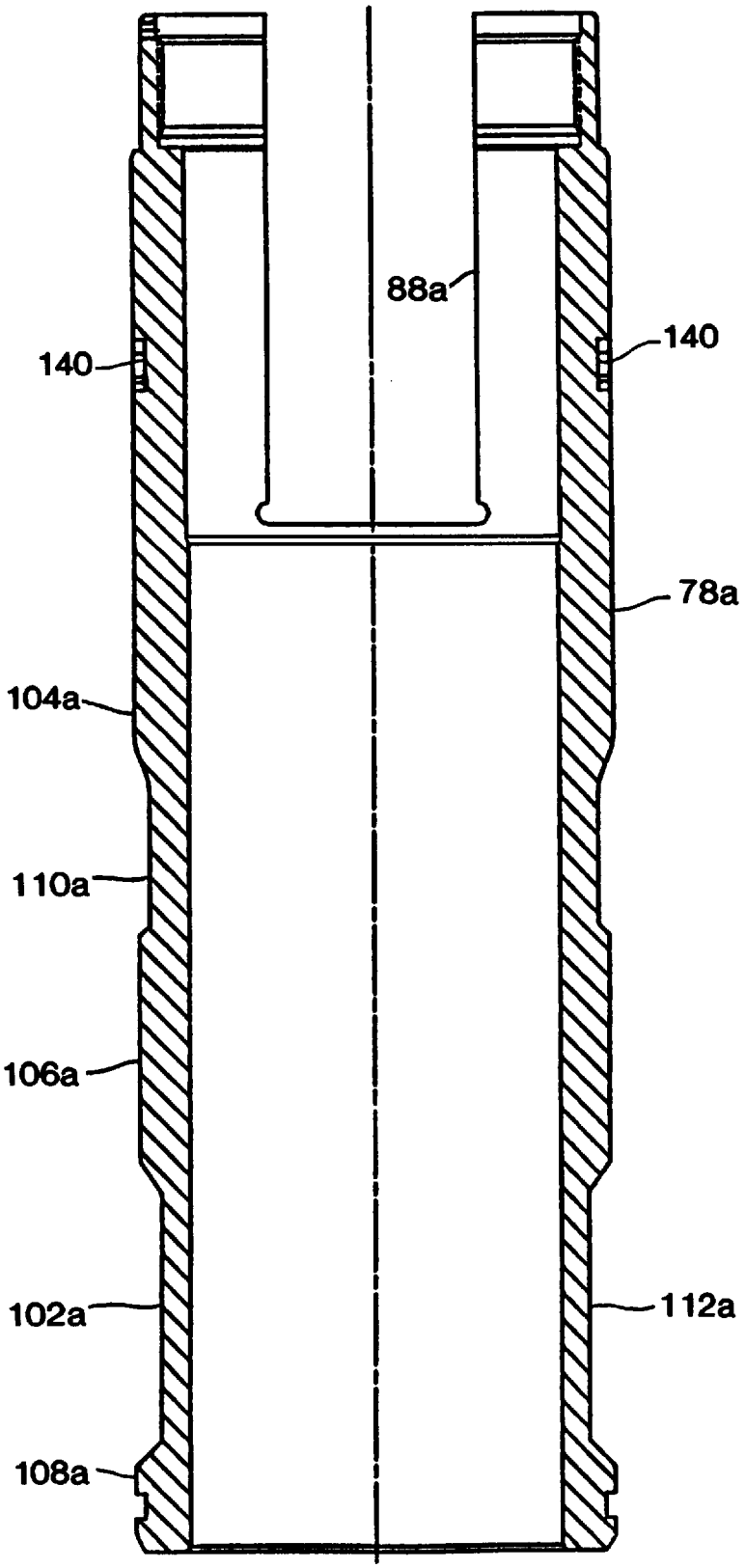
FIG. 7 is a cross-sectional view of an expander sleeve portion of the lock mandrel of FIG. 5.
Figure 8:
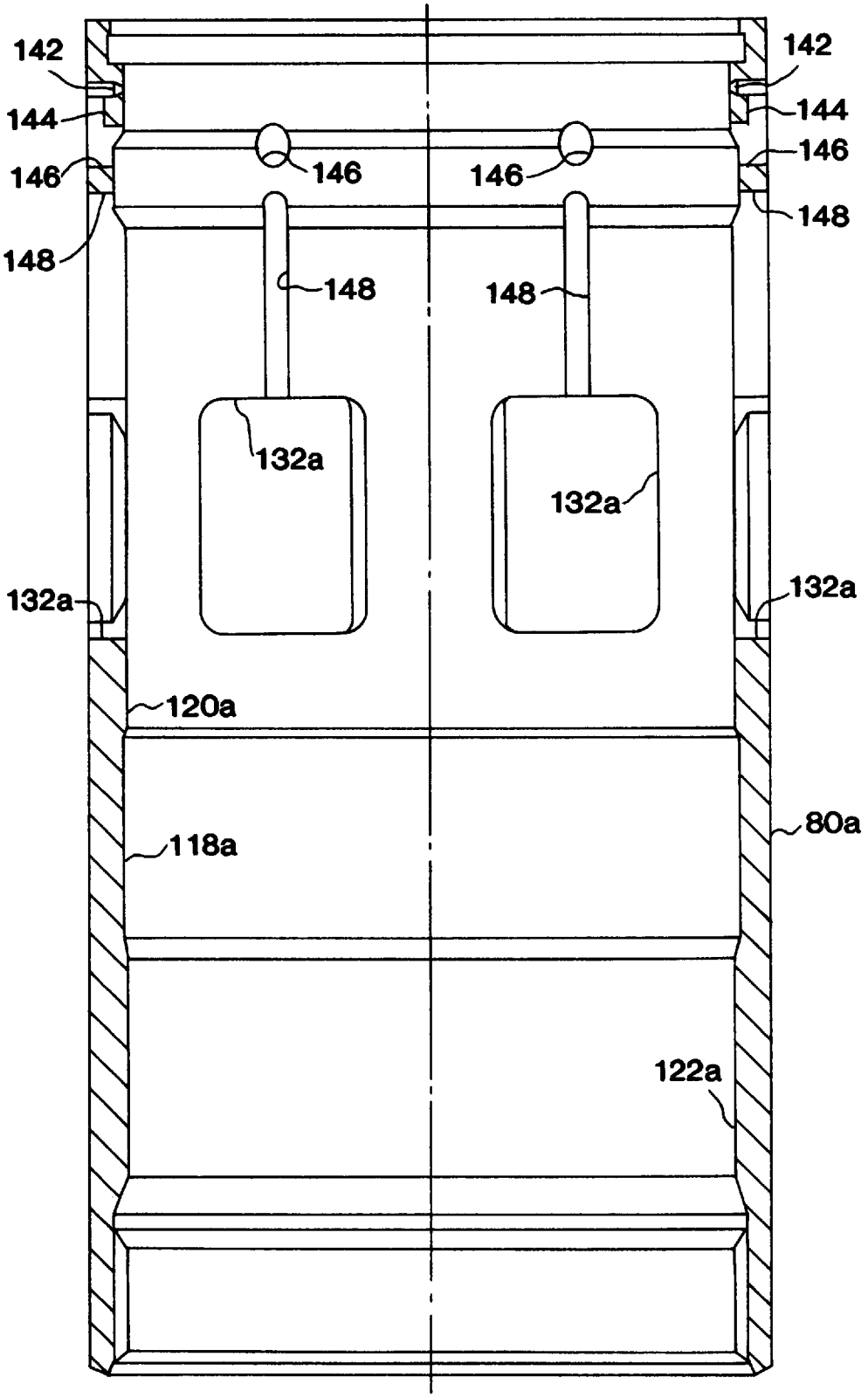
FIG. 8 is a cross-sectional view of an outer housing portion of the lock mandrel of FIG. 5.
Figure 9:
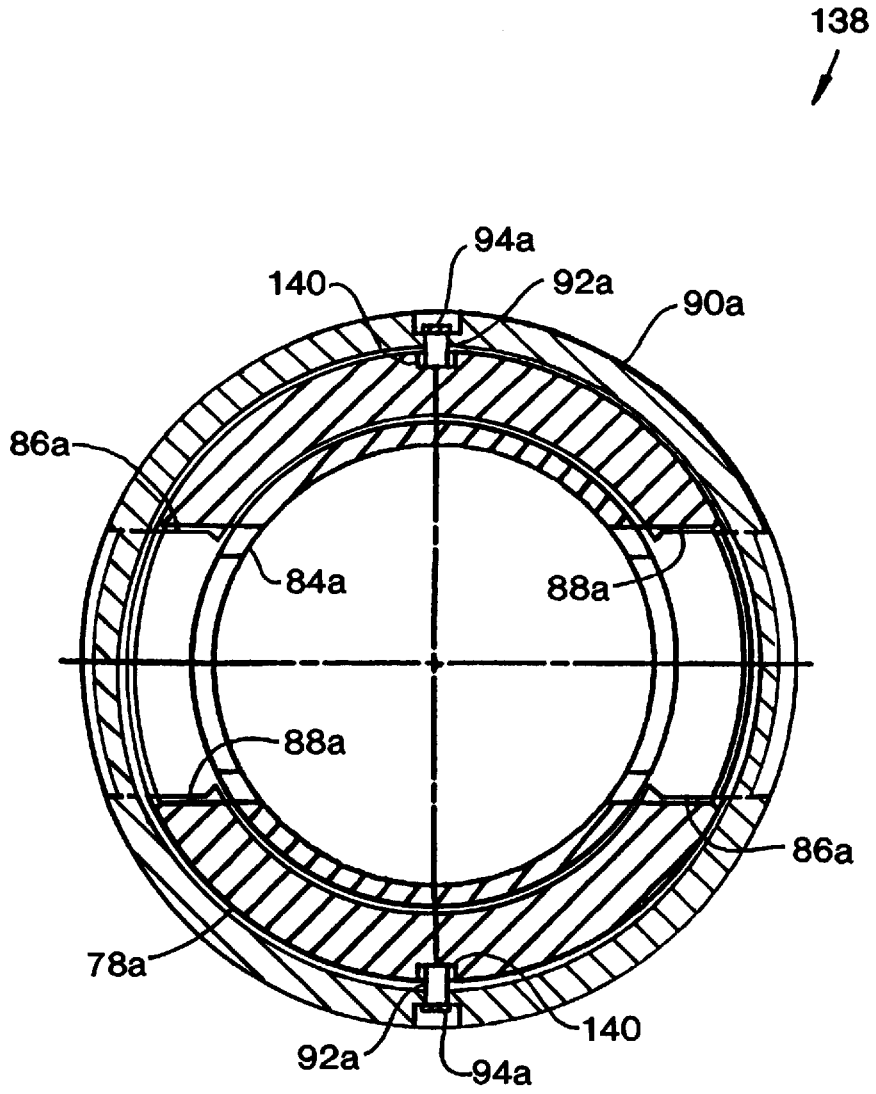
FIG. 9 is a cross-sectional view of the lock mandrel of FIG. 5, the view being taken along line 9—9 thereof.

Referring additionally now to FIGS. 6, 7, 8, and 9, various elements of the lock mandrel 138 are representatively illustrated. FIGS. 6, 7, and 8 show the inner mandrel 84*a*, expander sleeve 78*a*, and outer housing 80*a*, respectively, apart from the remainder of the lock mandrel 138 and enlarged for illustrative clarity. FIG. 9 shows a cross-sectional view of the lock mandrel 138, taken along line 9—9 of FIG. 5, in which various elements of the lock mandrel may be viewed in relation to other elements thereof.

In FIG. 9, the manner in which the portions 86*a* of the inner mandrel axially slidingly engage the slots 88*a* of the expander sleeve 78*a* is clearly visible. Additionally, the spatial relationship of the shear pins 92*a*, springs 94*a*, and recesses 140 relative to the portions 86*a* may also be clearly seen. In FIG. 8, it may be seen that a recess 142, adjacent radially reduced portion 144, and adjacent opening 146 formed on the outer housing 80*a* cooperates with an aligned axially extending slot 148 to retain each of the springs 134*a*. Each of the slots 148 extends to a corresponding one of the openings 132*a*.

It will be readily appreciated by one of ordinary skill in the art that the unique configuration of the inner mandrel 84*a*, expander sleeve 78*a*, and outer housing 80*a*, along with other elements of the lock mandrel 138, greatly reduce the complexity, number of elements, assembly difficulties, inventory, etc., associated therewith. For example, compare the number of elements in the lock mandrel 138 or 70 with the number of elements in the lock mandrel 10 shown in FIGS. 1A–1D.

Of course, modifications may be made to the lock mandrels 70, 138 and nipple 46, such as those that would be obvious to one ordinarily skilled in the art, without departing from the principles of the present invention. Accordingly, the foregoing detailed description is to be clearly understood as being given by way of illustration and example only, the spirit and scope of the present invention being limited solely by the appended claims.

What is claimed is:

1. A nipple for use in a subterranean well in conjunction with a well tool having a radially outwardly extendable seal carried thereon, the nipple comprising:

a generally tubular housing;

a generally cylindrical internal bore extending axially through the housing, the internal bore having a first portion thereof with a first diameter;

a shoulder formed internally on the housing, the shoulder being capable of axially engaging the well tool when the well tool is inserted axially into the internal bore; and a seal surface formed internally on the housing, the seal surface being axially spaced apart from the shoulder, the seal surface having a second diameter greater than the first diameter of the first portion of the internal bore, and the seal surface further being capable of sealing engagement with the seal when the seal is radially outwardly extended from the well tool.

2. The nipple according to claim 1, wherein the internal bore has a second portion thereof, the second portion having a third diameter less than the second diameter of the seal surface.

3. The nipple according to claim 2, wherein the first and second internal bore portions axially straddle the seal surface.

4. The nipple according to claim 1, wherein the second diameter is approximately 0.05 inch greater than the first diameter.

5. The nipple according to claim 1, wherein the shoulder is a portion of a latching profile formed on the internal bore.

6. The nipple according to claim 1, wherein the internal bore has a second portion thereof, the second portion having a third diameter less than the second diameter of the seal surface, wherein the first and second internal bore portions axially straddle the seal surface, and wherein the seal surface and shoulder axially straddle the first internal bore portion.

7. The nipple according to claim 1, wherein the shoulder faces in an axial direction, and wherein the seal surface is spaced apart from the shoulder in the axial direction.

8. For use with a well tool having a generally tubular outer housing and a circumferential seal, the seal being radially outwardly extendable relative to the outer housing, a full bore nipple comprising:

a generally tubular body, the body being configured for axial insertion of the well tool thereinto;

a first internal diameter extending axially within the body, the first internal diameter being capable of receiving the outer housing axially therein; and a second internal diameter extending axially within the body, the second internal diameter being radially outwardly disposed relative to the first internal diameter, and the second internal diameter being capable of engagement with the seal when the outer housing is received axially within the first internal diameter and the seal is radially outwardly extended relative to the outer housing.

9. The full bore nipple according to claim 8, wherein the body has a latching profile formed internally therein, the latching profile being capable of axially engaging the well tool to thereby axially engage the well tool with the body.

10. The full bore nipple according to claim 9, wherein the second internal diameter is axially spaced apart from the latching profile, and wherein the latching profile has a shoulder formed thereon, the shoulder being formed approximately orthogonal to a central axis of the body, and the shoulder facing axially toward the second internal diameter.

11. The full bore nipple according to claim 10, wherein the first internal diameter is axially adjacent each of the second internal diameter and the latching profile.

12. The full bore nipple according to claim 10, wherein the first internal diameter is axially adjacent the second internal diameter, and wherein the first internal diameter is axially spaced apart from the latching profile.

13. The full bore nipple according to claim 8, wherein the first internal diameter has first and second portions thereof, the first and second portions axially straddling the second internal diameter.

14. A method of configuring a tubing string within a subterranean well, the method comprising the steps of:

providing the tubing string having an internal drift diameter;

providing a nipple, the nipple including a generally tubular housing having opposite ends, the opposite ends being configured for interconnection of the housing within the tubing string, an axially extending internal bore formed in the housing, the internal bore having a diameter at least as large as the tubing string drift diameter, and a seal surface formed in the housing axially between the internal bore and one of the opposite ends, the seal surface being radially outwardly disposed relative to the internal bore;

interconnecting the nipple to the tubing string; and positioning the tubing string within the well.

15. The method according to claim 14, wherein the nipple providing step further comprises providing the nipple including a latching profile formed in the housing, the latching profile being formed axially between the internal bore and the other opposite end.

16. The method according to claim 14, wherein the nipple providing step further comprises providing the nipple including a latching profile formed in the housing, the latching profile being formed axially between the seal surface and the one of the opposite ends.

17. The method according to claim 14, further comprising the step of providing a well tool, the well tool including a generally tubular outer housing having an outer diameter less than the tubing string drift diameter and a radially outwardly extendable circumferential seal, the seal being radially inwardly disposed relative to the outer housing when the seal is retracted, and the seal being radially outwardly disposed relative to the outer housing when the seal is extended.

18. The method according to claim 17, further comprising the steps of disposing the well tool in the tubing string and positioning the well tool relative to the nipple, the seal being positioned radially opposite the seal surface.

19. The method according to claim 18, further comprising the step of extending the seal after the seal is positioned radially opposite the seal surface, the seal sealingly engaging the seal surface.

20. The method according to claim 19, further comprising the step of disposing the seal in the retracted position relative to the outer housing before the seal is positioned radially opposite the seal surface.

21. Apparatus for use in a subterranean well, the apparatus comprising:

a generally tubular mandrel;

a generally tubular expander sleeve axially slidingly disposed externally on the mandrel, the expander sleeve having first and second external diameters formed thereon, the second external diameter being larger than the first external diameter, the expander sleeve being selectively positionable in first and second axial positions relative to the mandrel, and the expander sleeve having an opening formed through a sidewall portion thereof;

an outer housing at least partially outwardly surrounding the expander sleeve;

a first circumferential seal disposed externally relative to the expander sleeve, the seal being disposed radially outward of the first external diameter when the expander sleeve is in the first position, and the seal being disposed radially outward of the second external diameter when the expander sleeve is in the second position;

a second circumferential seal sealingly engaging the expander sleeve and the outer housing; and a generally tubular outer sleeve axially slidingly disposed externally about the expander sleeve, the outer sleeve being attached to the mandrel through the expander sleeve opening.

22. Apparatus for use in a subterranean well, the apparatus comprising:

a generally tubular mandrel;

a generally tubular expander sleeve axially slidingly disposed externally on the mandrel, the expander sleeve having first and second external diameters formed thereon, the second external diameter being larger than the first external diameter, the expander sleeve being selectively positionable in first and second axial positions relative to the mandrel, and the expander sleeve having an opening formed through a sidewall portion thereof;

a circumferential seal disposed externally relative to the expander sleeve, the seal being disposed radially outward of the first external diameter when the expander sleeve is in the first position, and the seal being disposed radially outward of the second external diameter when the expander sleeve is in the second position;

a generally tubular outer sleeve axially slidingly disposed externally about the expander sleeve, the outer sleeve being attached to the mandrel through the expander sleeve opening;

one of the expander sleeve and the outer sleeve further having a recess externally formed thereon; and a shear member disposed radially extendably on the other of the expander sleeve and the outer sleeve.

23. The apparatus according to claim 22, wherein the shear member is axially spaced apart from the recess when the expander sleeve is in the first position, and wherein the shear member is capable of extending radially to engage the recess when the expander sleeve is in the second position, the expander sleeve and outer sleeve being releasably axially attached to each other when the shear member engages the recess.

24. Apparatus for use in a subterranean well, the apparatus comprising:

a generally tubular mandrel;

a generally tubular expander sleeve axially slidingly disposed externally on the mandrel, the expander sleeve having first and second external diameters formed thereon, the second external diameter being larger than the first external diameter, the expander sleeve being selectively positionable in first and second axial positions relative to the mandrel, and the expander sleeve having an opening formed through a sidewall portion thereof;

a first circumferential seal disposed externally relative to the expander sleeve, the seal being disposed radially outward of the first external diameter when the expander sleeve is in the first position, and the seal being disposed radially outward of the second external diameter when the expander sleeve is in the second position;

a generally tubular outer sleeve axially slidingly disposed externally about the expander sleeve, the outer sleeve being attached to the mandrel through the expander sleeve opening; and a generally tubular outer housing at least partially radially outwardly overlying the expander sleeve, the outer housing being attached to the inner mandrel.

25. The apparatus according to claim 24, wherein one of the expander sleeve and the outer housing has a seal surface formed thereon, and further comprising a second circumferential seal carried on the other one of the expander sleeve and the outer housing.

26. The apparatus according to claim 25, wherein the seal surface is axially spaced apart from the second seal when the expander sleeve is in the first position, and wherein the second seal sealingly engages the seal surface when the expander sleeve is in the second position.

27. Apparatus for use in a subterranean well, the apparatus comprising:

a generally tubular mandrel;

a generally tubular expander sleeve axially slidingly disposed externally on the mandrel, the expander sleeve having first and second external diameters formed thereon, the second external diameter being larger than the first external diameter, the expander sleeve being selectively positionable in first and second axial positions relative to the mandrel, and the expander sleeve having an opening formed through a sidewall portion thereof;

a circumferential seal disposed externally relative to the expander sleeve, the seal being disposed radially outward of the first external diameter when the expander sleeve is in the first position, and the seal being disposed radially outward of the second external diameter when the expander sleeve is in the second position;

a generally tubular outer sleeve axially slidingly disposed externally about the expander sleeve, the outer sleeve being attached to the mandrel through the expander sleeve opening;

an outer housing having an opening formed through a sidewall portion thereof; and a member radially slidingly disposed within the outer housing opening, the expander sleeve contacting the member to maintain the member in a radially outwardly disposed position relative to the outer housing opening when the expander sleeve is in the second position, and the expander sleeve permitting the member to radially inwardly retract when the expander sleeve is in the first position.

28. Apparatus for use in a subterranean well, the apparatus comprising:

a generally tubular mandrel, the mandrel having a radially outwardly extending portion formed thereon;

a generally tubular expander sleeve axially slidinyly disposed externally on the mandrel, the expander sleeve having first and second external diameters formed thereon, the second external diameter being larger than the first external diameter, the expander sleeve being selectively positionable in first and second axial positions relative to the mandrel, the expander sleeve having first and second openings formed through a sidewall portion thereof, the mandrel portion being axially slidingly received in the second opening and preventing circumferential displacement of the expander sleeve relative to the mandrel;

a circumferential seal disposed externally relative to the expander sleeve, the seal being disposed radially outward of the first external diameter when the expander sleeve is in the first position, and the seal being disposed radially outward of the second external diameter when the expander sleeve is in the second position; and a generally tubular outer sleeve axially slidingly disposed externally about the expander sleeve, the outer sleeve being attached to the mandrel through the expander sleeve first opening.

29. Apparatus for use in a subterranean well, the apparatus comprising:

a generally tubular mandrel having opposite ends;

a generally tubular housing having opposite ends, said housing being radially outwardly disposed relative to the mandrel and at least partially radially spaced apart therefrom, and one of the housing opposite ends being attached to one of the mandrel opposite ends;

a first circumferential seal; and a generally tubular expander sleeve having an outer side surface, the expander sleeve being axially reciprocably disposed radially between the mandrel and the housing, and the expander sleeve being positionable relative to the housing in a selected one of first and second axial positions, the first circumferential seal sealingly engaging the expander sleeve outer side surface and the housing when the expander sleeve is in the second axial position.

30. The apparatus according to claim 29, further comprising a second circumferential seal, the second circumferential seal sealingly engaging the expander sleeve outer side surface when the expander sleeve is in the second axial position.

31. The apparatus according to claim 30, wherein the expander sleeve outer side surface has first and second axially spaced apart portions thereof, the first circumferential seal sealingly engaging the first portion and the second circumferential seal sealingly engaging the second portion when the expander sleeve is in the second axial position.

32. The apparatus according to claim 31, wherein an outer diameter of the first portion is approximately equal to an outer diameter of the second portion.

33. The apparatus according to claim 29, further comprising a key member, the key member being radially outwardly extendable relative to the housing.

34. The apparatus according to claim 33, wherein the expander sleeve outer side surface has a third portion thereof axially spaced apart from the first and second portions, and wherein the third portion radially inwardly contacts the key member such that the key member is radially outwardly extended when the expander sleeve is in the second axial position.

35. Apparatus for connection to a tubing string positionable within a subterranean well, the tubing string having an inner side surface, the apparatus comprising:

a generally tubular housing having first and second opposite ends and inner and outer side surfaces, the housing being axially displaceable through the tubing string;

first and second circumferential seals; and a generally tubular expander sleeve having first and second opposite ends and inner and outer side surfaces, and the expander sleeve being positionable relative to the housing in a selected one of first and second positions, the expander sleeve outer side surface and the housing inner side surface being sealingly engaged by the first circumferential seal, and the second circumferential seal sealingly engaging the expander sleeve outer side surface when the expander sleeve is in the second position, and the second circumferential seal sealingly engaging the tubing string inner side surface when the expander sleeve is in the second position.

36. The apparatus according to claim 35, further comprising a radially outwardly extendable member carried on the housing, the member being radially inwardly displaceable by contact with the tubing string inner side surface when the expander sleeve is in the first position, and the expander sleeve preventing radially inward displacement of the member when the expander sleeve is in the second position.

37. The apparatus according to claim 35, wherein the second circumferential seal is radially inwardly disposed relative to the housing when the expander sleeve is in the first position, and wherein the second circumferential seal is radially outwardly disposed relative to the housing when the expander sleeve is in the second position.

38. Apparatus for connection to a tubing string positionable within a subterranean well, the tubing string having an inner side surface, the apparatus comprising:

a generally tubular housing having first and second opposite ends and inner and outer side surfaces, the housing being axially displaceable through the tubing string;

first and second circumferential seals;

a generally tubular expander sleeve having first and second opposite ends and inner and outer side surfaces, and the expander sleeve being positionable relative to the housing in a selected one of first and second positions, the expander sleeve outer side surface and the housing inner side surface being sealingly engaged by the first circumferential seal, and the second circumferential seal sealingly engaging the expander sleeve outer side surface when the expander sleeve is in the second position, and the second circumferential seal sealingly engaging the tubing string inner side surface when the expander sleeve is in the second position; and a generally tubular mandrel at least partially received axially within the expander sleeve, the mandrel being attached to the housing second opposite end.

39. The apparatus according to claim 38, wherein the mandrel axially contacts the expander sleeve when the expander sleeve is in the first position, such that the mandrel and housing are axially displaceable by axial displacement of the expander sleeve.

40. The apparatus according to claim 38, wherein the mandrel extends radially outwardly through an opening formed on the expander sleeve.

* * * * *